US006163302A

United States Patent [19]

Björkengren et al.

[11] Patent Number: 6,163,302

[45] Date of Patent: Dec. 19, 2000

[54] FLEXIBLE DUAL-MODE ANTENNA FOR MOBILE STATIONS

[75] Inventors: Ulf Björkengren, Bjärred; Zhinong Ying, Lund, both of Sweden

[73] Assignee: Telefonaktiebolaget LM Ericsson (publ), Stockholm, Sweden

[21] Appl. No.: 09/429,066

[22] Filed: Oct. 29, 1999

[51] Int. Cl.[7] ..... H01Q 1/24

[52] U.S. Cl. ..... 343/702; 455/90

[58] Field of Search ..... 343/702, 700 MS, 343/725, 729, 895; 455/90

[56] References Cited

U.S. PATENT DOCUMENTS

| | | | |
|---|---|---|---|
| 3,913,109 | 10/1975 | Owen | 343/880 |
| 5,170,176 | 12/1992 | Yasunaga et al. | 343/895 |
| 5,216,436 | 6/1993 | Hall et al. | 343/895 |
| 5,640,689 | 6/1997 | Rossi | 455/89 |
| 5,828,348 | 10/1998 | Tassoudji et al. | 343/895 |
| 5,909,197 | 6/1999 | Heinemann et al. | 343/895 |
| 5,943,021 | 8/1999 | Hayes et al. | 343/702 |
| 6,088,579 | 7/2000 | Sepponen | 455/90 |
| 6,088,603 | 7/2000 | Wilson | 455/575 |

FOREIGN PATENT DOCUMENTS

| | | |
|---|---|---|
| 0 801 434 A1 | 10/1997 | European Pat. Off. . |
| 2 302 992 | 2/1997 | United Kingdom . |
| WO 98/09342 | 3/1998 | WIPO . |

OTHER PUBLICATIONS

EPO International Search Reported dated Jun. 27, 2000.

*Primary Examiner*—Hoanganh Le
*Assistant Examiner*—Trinh Vo Dinh
*Attorney, Agent, or Firm*—Jenkens & Gilchrist, P.C.

[57] ABSTRACT

A dual-mode Mobile Station (MS) supports both a satellite mode and a cellular mode using a combined swivel-type cellular and satellite antenna. The combined antenna has on one end a quarter wave stub for the cellular mode, and at the other end a compressible quadrifilar helical antenna for the satellite mode. The satellite antenna is preferably made of a plastic film in the form of a cylinder, on which a metallized film is deposited. The plastic film is filled with a foam rubber that keeps its cylindrical form. In the cellular mode, the flexible satellite antenna is compressed between the main housing of the MS and a sliding lid on the side of the MS to occupy a volume that is only a fraction of its uncompressed volume. In the satellite mode, the lid is opened and the combined antenna is rotated 90 to 180 degrees, at which point the satellite antenna resumes its cylindrical form due to the foam rubber expanding or mechanical driving inside of the plastic film.

27 Claims, 7 Drawing Sheets

FLEXIBLE DUAL-MODE ANTENNA FOR MOBILE STATIONS

BACKGROUND AND OBJECTS OF THE PRESENT INVENTION

At a basic level, wireless telecommunications systems transmit speech and data between a cellular network and a wireless telephone, hereinafter referred to as a Mobile Station (MS), over an air interface. Both the cellular network and the MS include transmitter and receiver functions, which convert information contained in the speech frequency to the frequency required for transmission through the desired medium (air and/or space). This process is called modulation.

On the MS side, the modulated speech signal is transmitted to the cellular network through an antenna on the MS. The MS antenna takes the power from the MS and radiates it out into space as radio frequency (RF) waves. The relevant range of RF waves for cellular telecommunications services are separated into different groups. The bands at 800 and 1900 MegaHertz (MHz) are reserved for cellular and Personal Communications Services (PCS) wireless systems, respectively, while the bands reserved for satellite services are scattered above 2.5 GigaHertz (GHz).

Since the frequency of an RF wave is inversely proportional to the wavelength of the RF wave, the wavelength of a satellite RF wave is substantially shorter than the wavelength of a cellular RF wave. The transmitted wavelength has a significant impact on design characteristics of the MS's, such as the size of the antenna. Typically, the smaller the wavelength, the larger the antenna needed to transmit the RF wave.

Thus, the antennas needed for satellite MS's are much larger than the antennas needed for cellular MS's. Typically, satellite MS antennas have a diameter of 15–20 mm and a length of about 14 cm. As this represents a volume of 40 to 100 percent of the leading small cellular MS's today, this alone means that the satellite MS's will be considered large in comparison to cellular MS's.

For example, one type of antenna for a satellite MS is a quadrifilar helix, which consists of four helical conducts, with a 90-degree phase shift, around a cylinder with a diameter of 15–20 mm and a length of 140 mm. Although this type of antenna provides excellent coverage for satellite transmissions, it occupies a large volume compared to the rest of the phone, which makes it difficult to design satellite MS's that are comparable in size to cellular phones. Other parameters, such as battery size, may also make the satellite MS larger, but eliminating the antenna volume on satellite MS's would yield a significant difference.

The problem is even more acute in dual-mode MS's. Dual-mode MS's have both a cellular antenna and a satellite antenna. Dual-mode MS's offer many advantages to mobile subscribers. For example, an owner of a dual-mode MS may only need to carry one MS for call origination and call delivery anywhere in the world. While in the home area, the mobile subscriber can switch the MS to cellular mode and use the cellular antenna to make and receive calls through a terrestrial cellular network, such as a Global System for Mobile Communications (GSM) network or a Digital Advanced Mobile Phone Service (D-AMPS) network. However, when the mobile subscriber roams out of the home area, instead of paying outrageous roaming charges or losing service in an unpopulated area, the mobile subscriber can switch to satellite mode and use the satellite antenna to make and receive calls through a satellite network.

However, as is the case for satellite MS's, dual-mode MS's must also include a large satellite antenna. The size of the satellite antenna alone has deterred mobile subscribers and network operators alike from investing in dual-mode MS's. In addition, the practical implications of where and how to store the satellite antenna while in cellular mode have perplexed dual-mode MS manufacturers and limited the interest in such dual-mode MS's.

It is, therefore, an object of the present invention to provide an integrated dual-mode MS having both a satellite antenna and a cellular antenna attached thereto.

It is a further object of the present invention to provide for the convenient storage of the satellite antenna within the dual-mode MS during operation of the cellular antenna.

It is still a further object of the present invention to provide for convenient activation of the satellite antenna when the dual-mode MS is in satellite mode.

SUMMARY OF THE INVENTION

The present invention is directed to a dual-mode Mobile Station (MS) having a combined swivel-type cellular and satellite antenna that supports both a satellite mode and a cellular mode. The combined swivel antenna has on one end a quarter wave stub for the cellular mode, and at the other end a compressible quadrifilar helical antenna for the satellite mode. The satellite antenna is preferably made of a plastic film in the form of a cylinder, on which a metallized film is deposited. The plastic film is filled with a foam rubber that keeps its cylindrical form. In the cellular mode, the flexible satellite antenna is compressed between the main housing of the MS and a sliding lid on the side of the MS to occupy a volume that is only a fraction of its uncompressed volume. In the satellite mode, the lid is opened and the combined antenna is rotated 90 to 180 degrees, at which point the satellite antenna resumes its cylindrical form due to the foam rubber expanding or mechanical driving inside of the plastic film.

BRIEF DESCRIPTION OF THE DRAWINGS

The disclosed invention will be described with reference to the accompanying drawings, which show important sample embodiments of the invention and which are incorporated in the specification hereof by reference, wherein.

DETAILED DESCRIPTION OF THE PRESENTLY PREFERRED EXEMPLARY EMBODIMENTS

Figure 1:
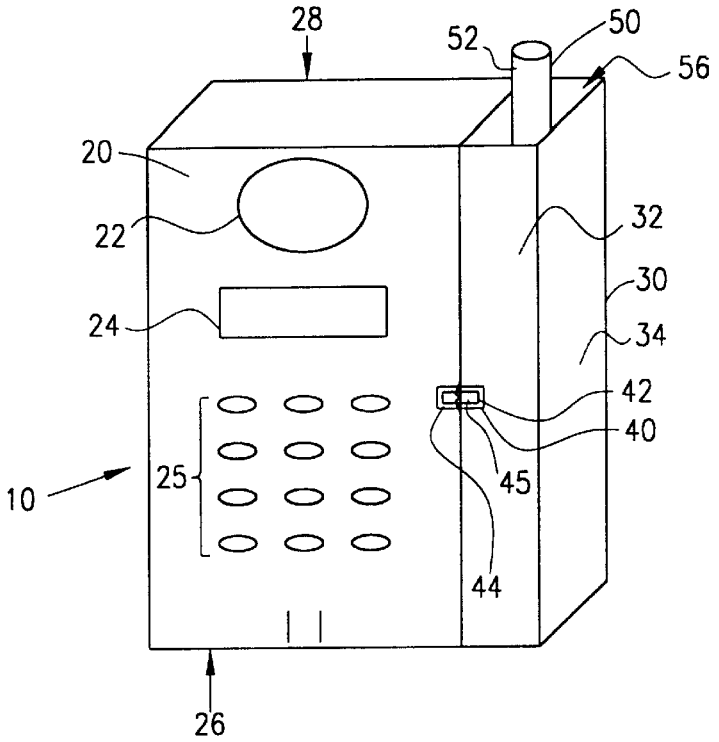
FIG. 1 is a front view of a dual-mode Mobile Station (MS) having a cellular end of a combined swivel antenna exposed, in accordance with embodiments of the present invention.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Referring now to the drawings in detail, in which like numerals indicate like elements throughout, FIGS. 1–5 depict a handheld portable phone, hereinafter referred to as a Mobile Station (MS) 10, generally capable of operating in the dual modes of satellite communication and cellular communication. The MS 10 includes a main housing 20 and a sliding lid 30 removably attached to the main housing 20. From FIGS. 1, 3 and 5 it can be seen that a front surface 26 of the main housing 20 offers access to a keypad 25, a display 24 and a speaker 22.

Figure 3:
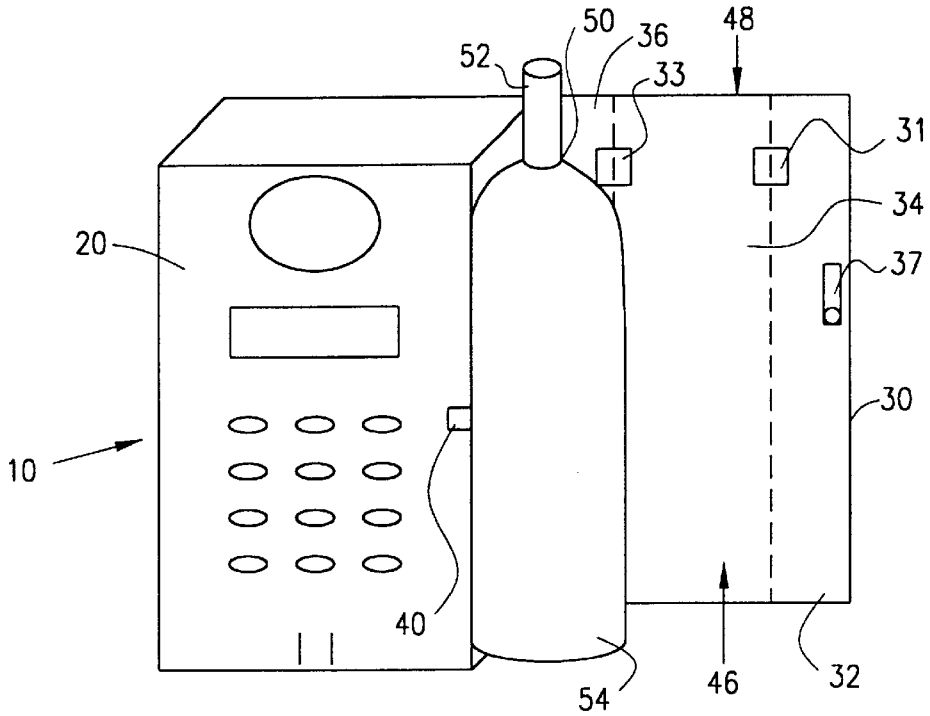
FIG. 3 is a front view of the dual-mode MS having an opened side lid exposing a satellite end of the combined swivel antenna, in accordance with embodiments of the present invention.
Figure 4:
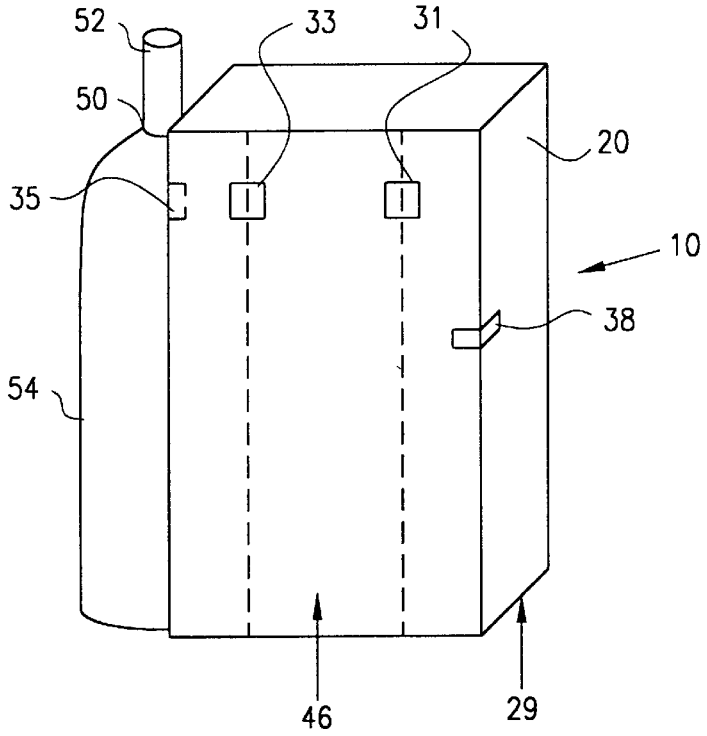
FIG. 4 is a perspective view of the back of the dual-mode MS shown in FIG. 3 of the drawings.
Figure 5:
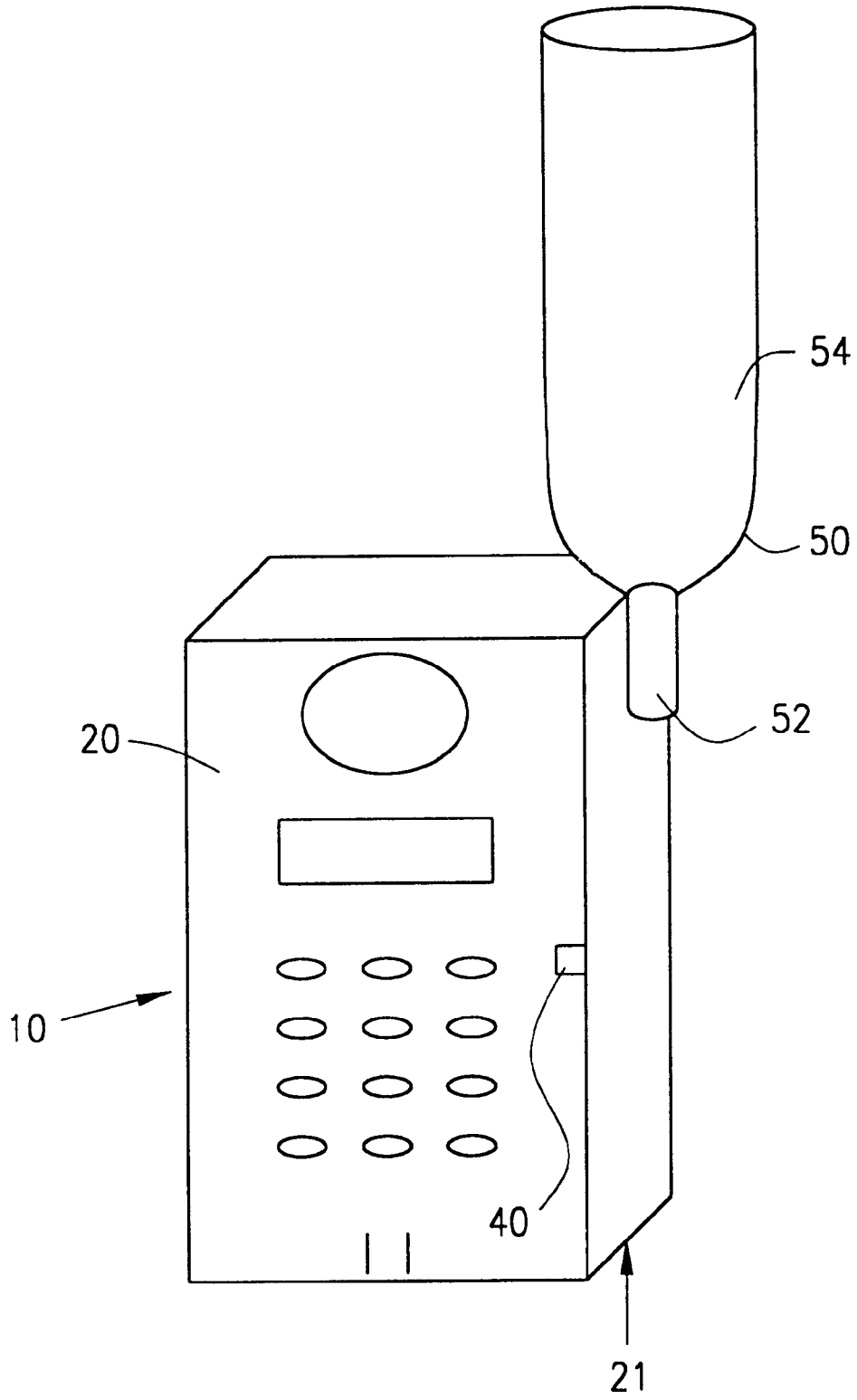
FIG. 5 is a front view of the dual-mode MS shown in FIG. 3 of the drawings, in which the combined swivel antenna has been rotated 180 degrees.

As shown in FIGS. 3–5, the MS 10 further includes a combined swivel antenna 50 rotatably secured to an upper edge of an inner side surface 21 of the main housing 20 about an intersection between a cellular end 52 and a compressible satellite end 54 of the combined swivel antenna 50. The cellular end 52 of the combined swivel antenna 50 is capable of receiving and transmitting signals in the cellular mode, and the compressible satellite end 54 is capable of receiving and transmitting signals in the satellite mode. The cellular end 52 of the combined swivel antenna 50 is linearly polarized and preferably a monopole type antenna, such as a quarter wave stub. The compressible satellite end 54 of the combined swivel antenna 50 is circularly polarized and preferably a four wire helical antenna, such as a quadrifilar helix. Alternatively, a patch antenna can be used for the satellite end 54 of the combined antenna 50.

In FIG. 1, the sliding lid 30 is shown in the closed position. A release latch 40 secures a front surface 32 of the sliding lid 30 to a front surface 26 of the main housing 20. The release latch 40 shown in FIG. 1 includes an engaging component 42 attached to the sliding lid 30 and a receiving component 44 attached to the main housing 20. To secure the release latch 40, a user of the MS 10 fastens the engaging component 42 to the receiving component 44, typically by snapping one into the other. To detach the sliding lid 30, a user pressing a release switch 45 to disengage the engaging component 42 from the receiving component 44. However, it should be noted that any fastening device can be used instead of the release latch 40.

Figure 2:
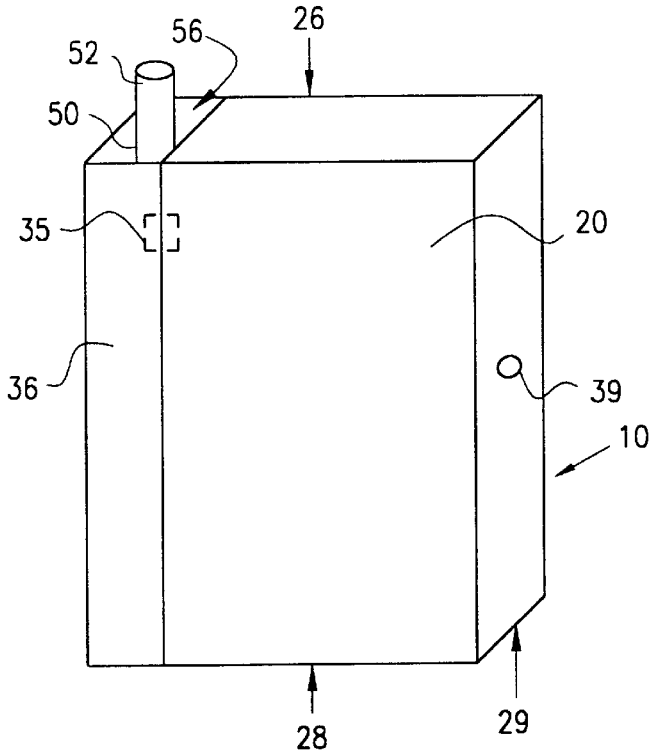
FIG. 2 is a back view of the dual-mode MS shown in FIG. 1 of the drawings.

Referring now to FIGS. 2–4, the sliding lid 30 is also shown having three surfaces 32, 34 and 36. A front surface 32 and a side surface 34 of the sliding lid 30 are connected together by means of a first hinge 31, while the side surface 34 and a back surface 36 are connected together by means of a second hinge 33 (as shown in FIGS. 3 and 4). The back surface 36 of the sliding lid 30 couples to the main housing 20 by means of a third hinge 35 (as shown in FIG. 2). The hinges 31, 33 and 35 are preferably located on an interior side 46 of the sliding lid 30, so as to not be detectable by users of the MS 10. Alternatively, the hinges 31, 33 and 35 could be located on an exterior side 48 of the sliding lid 30. It should be noted that there can be one or more hinges connecting the surfaces to each other and to the main housing, and the hinges can be located at any point on the surfaces.

Figure 6:
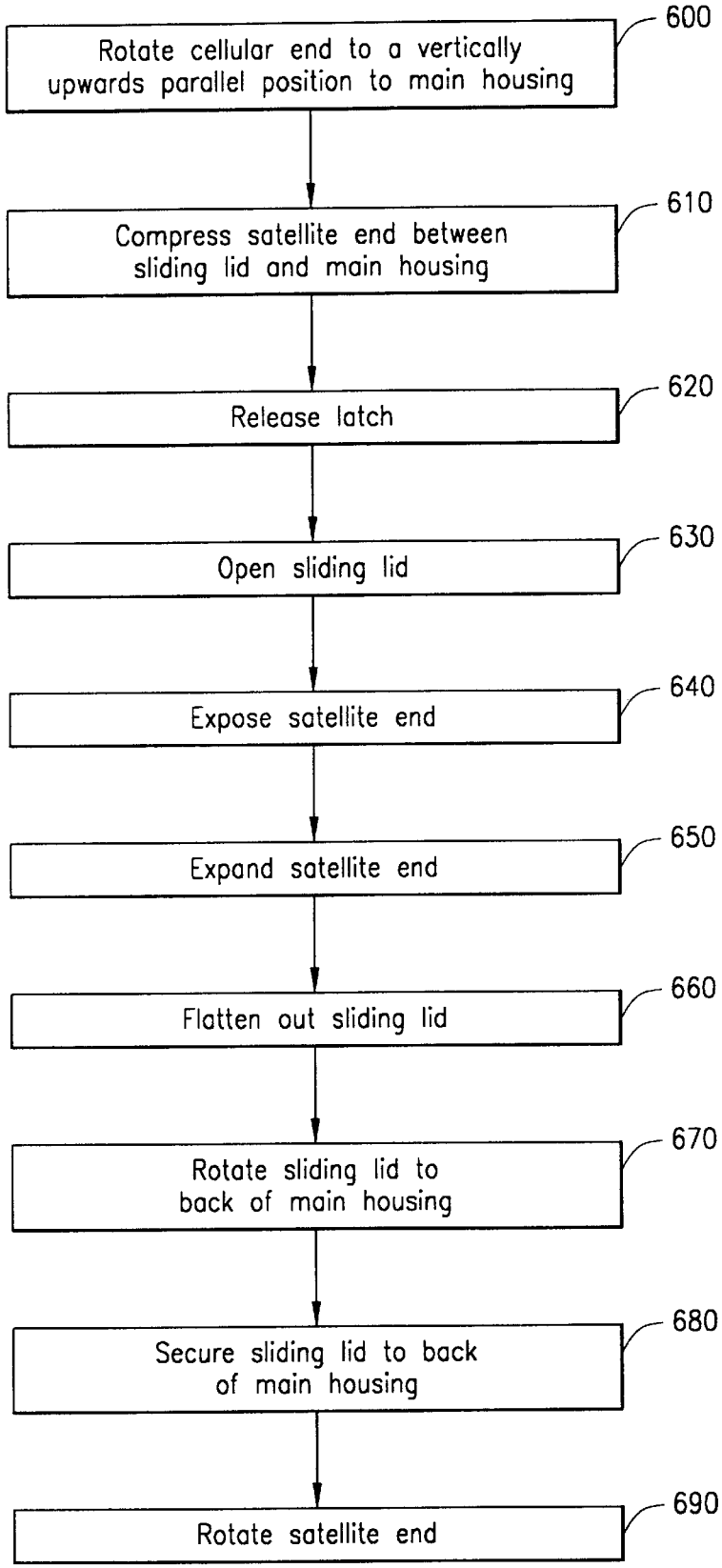
FIG. 6 is a flow chart illustrating the steps for operating the dual-mode MS in cellular mode and satellite mode.

With reference now to FIG. 6 of the drawings, operation of the dual-mode MS 10 will now be described in connection with FIGS. 1–5. In FIGS. 1 and 2, the dual-mode MS 10 is shown operating in the cellular mode. The cellular end 52 of the combined swivel antenna 50 has been rotated to a vertically upwards parallel position with respect to the main housing 20 (step 600), and is shown protruding through an open cavity 56 formed by the three surfaces 32, 34 and 36 of the sliding lid 30. The satellite end 54 of the combined swivel antenna 50 (not visible in FIGS. 1 and 2) is compressed within this cavity 56 (step 610). Preferably, the cavity 56 has a width greater than or substantially equal to the diameter of the cellular end 52 of the combined swivel antenna 50. Thus, when the sliding lid 30 is in a closed position, the satellite end 54 of the combined swivel antenna 50 can be compressed between the main housing 20 of the MS 10 and the sliding lid 30 to occupy a volume that is only a fraction of its uncompressed volume.

As shown in FIG. 3, when the user of the dual-mode MS 10 wants to switch to satellite mode, the user disengages the release latch 40 (step 620), e.g., by pressing the release switch 45, and extends the sliding lid 30 to an open position (step 630) to expose the satellite end 54 of the combined swivel antenna 50 (step 640). Once the sliding lid 30 is opened, the compressed satellite end 54 of the combined swivel antenna 50 resumes its cylindrical form due to foam rubber within the satellite end 54 expanding or mechanical driving inside of the satellite antenna 54 (step 650). The compression and expansion process will be described in greater detail hereinafter.

In order for the user to hold the dual-mode MS 10 in an ergonomic manner in satellite mode, the sliding lid 30 can be flattened-out (step 660), as shown in FIG. 3, using the first and second hinges 31 and 33, respectively, and rotated 180 degrees (step 670), as shown in FIG. 4, using the third hinge 35, until the exterior side 46 of the sliding lid 30 lies over a back surface 28 of the main housing 20, exposing the interior side 48 of the sliding lid. Preferably, a snap 38 or other fastening device secures the flattened-out sliding lid 30 to the back surface 28 of the main housing 20 (step 680). For example, a flexible strip of material having an engaging end 37 of the snap 38 at the end thereof can be attached to the interior side 46 of the front surface 32 of the sliding lid 30 (shown in FIG. 3), and a receiving end 39 of the snap 38 can be attached to an outer side surface 29 of the main housing 20 (shown in FIG. 2). To secure the flattened-out sliding lid 30 to the back surface 28 of the main housing 20, the receiving end 39 of the snap 38 can be oriented to receive the engaging end 37 of the snap 38, as shown in FIG. 4.

The satellite mode of communication involves a directional component, in which link margin between the dual-mode MS 10 and an applicable satellite (not shown) is improved when the satellite end 54 of the combined swivel antenna 50 is positioned in alignment therewith. Therefore, as shown in FIG. 5, to effectively communicate in satellite mode, the satellite end 54 of the combined swivel antenna 50 can be rotated to a position perpendicular to the ground (step 690). Rotation of the combined swivel antenna 50 from a position parallel to the main housing 20 with the cellular end 52 vertically upwards to a position in which the satellite end 54 is perpendicular to the ground switches the dual-mode MS 10 from cellular mode into satellite mode. Likewise, rotation of the combined swivel antenna 50 back into the parallel position with the cellular end 52 vertically upwards switches the dual-mode MS 10 back into cellular mode.

Depending on how the user holds the dual-mode MS 10, to communicate effectively in satellite mode, the user may need to rotate the satellite end 54 of the combined swivel antenna 50 anywhere between 90 and 180 degrees in order to have the satellite end 54 of the combined swivel antenna 50 perpendicular to the ground. Additionally, depending on whether the user is right or left-handed, the user may need to rotate the combined swivel antenna 50 towards the front surface 26 of the main housing 20 or towards the back surface 28 of the main housing 20. Therefore, in preferred embodiments, any rotation in either direction of the combined swivel antenna 50 from a parallel position with the cellular stub 52 vertically upwards switches the dual-mode MS 10 into satellite mode.

The compression and expansion of the satellite end 54 of the combined antenna 50 will now be described in connection with FIGS. 7–8. With reference now to FIGS. 7A and 7B of the drawings, the satellite antenna 54 is preferably made of a plastic film 60 in the form of a cylinder having a fully expanded diameter of 15–20 mm and a length of 140 mm. The plastic film preferably consists of a laminated layer of Oriented Polyesther (OPET) having a thickness of about 12 micrometers, over a 300 Angstrom layer of Aluminum, which is over an underlying 50 micrometer layer of Polyethylene Low Density (PELD). It should be noted that the thicknesses and materials may vary depending on the manufacturer. For example, gold could be substituted for aluminum to increase the conductivity of the plastic film. A metallized film 62 having a pattern realizing four helical conducts, with a 90-degree phase shift, is deposited onto this plastic film 60. The plastic film 60 is filled with a foam rubber 65 that expands to the cylindrical form when the satellite antenna 54 is released.

Figure 7A:
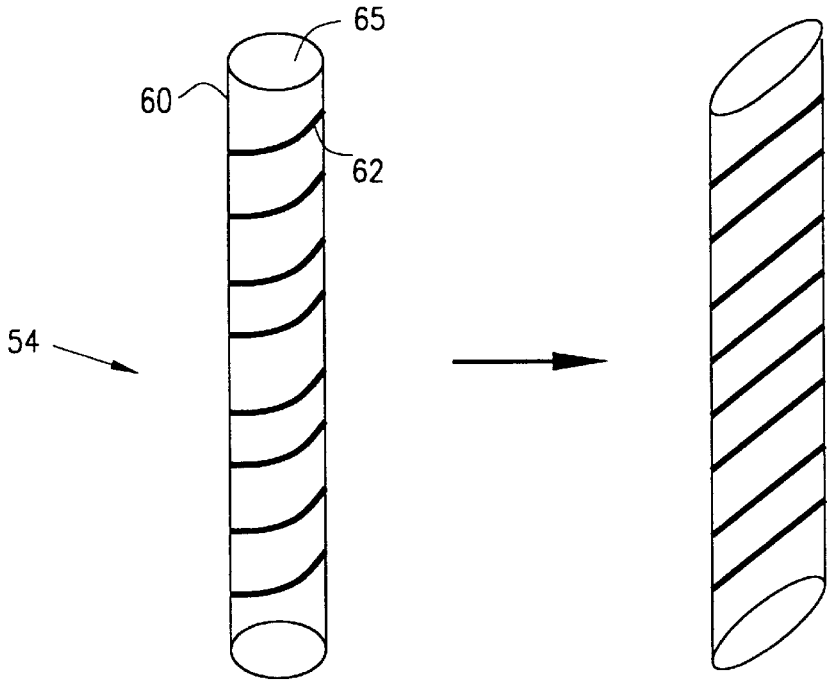
FIGS. 7A and 7B illustrate two alternative compressions and expansions of the satellite end of the combined swivel antenna shown in FIG. 2 of the drawings, in accordance with preferred embodiments of the present invention.

As shown in FIG. 7A, to compress the satellite antenna 54, force can be applied to flatten the satellite antenna 54 by shifting one side of one end of the satellite antenna 54 upwards and one side of the other end downwards. This allows the foam rubber 65 to compress into a vertically extended position, which is preferred in cases where the satellite antenna 54 has a diameter substantially equal to the width of the sides 21 and 29 of the main housing 20 (shown in FIGS. 3–5). Alternatively, the satellite antenna 54 could be flattened out horizontally, which is preferred in cases where the satellite antenna 54 has a length substantially equal to the length of the main housing 20.

Figure 7B:
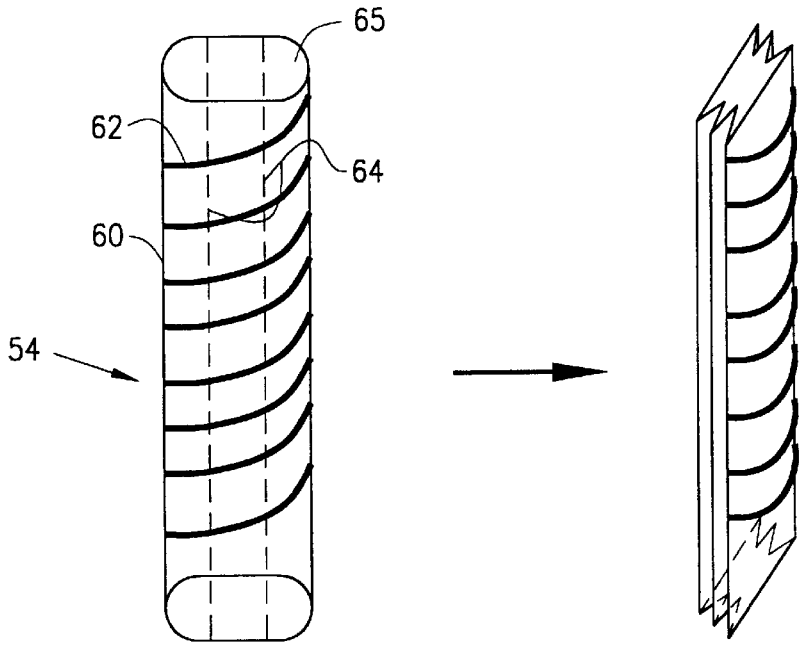

As shown in FIG. 7B, for larger satellite antennas 54 that have a width and length substantially equivalent to the main housing 20, instead of the plastic film 60 having a circular shape, the plastic film 60 can have an oval shape, with matching folds 64 in the plastic film 60 on opposite sides of the oval. Therefore, when the satellite antenna 54 is compressed, the plastic film 60 is folded into a zig-zap pattern, having a length substantially equivalent to the expanded satellite antenna 54 and a width substantially equivalent to the diameter of the expanded oval shape across the folds 64. The folds 64 are shown in FIG. 7B on the elongated sides of the oval, but it should be understood that the folds 64 could instead be included on the shorter sides of the oval. The position of the folds 64 depends on the orientation of the satellite antenna 54. It should also be understood that for any of the above-described satellite antenna compression configurations, in order to fully compress the satellite antenna 54, a user must apply a minimum amount of force when closing the sliding lid 30 (shown in FIG. 1).

Figure 8:
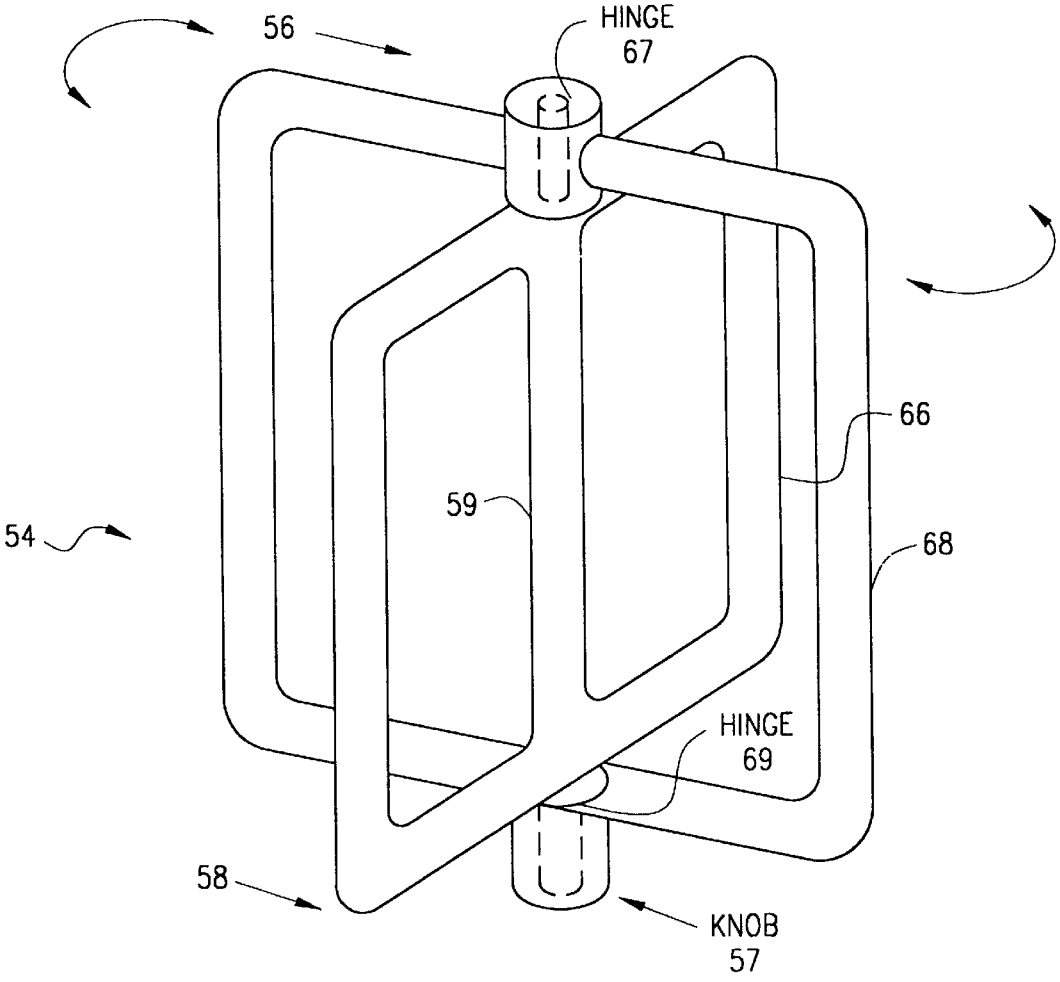
FIG. 8 illustrates the mechanical compression and expansion of the satellite end of the combined swivel antenna, in accordance with alternative embodiments of the present invention.

With reference now to FIG. 8 of the drawings, as an alternative to the user applying force to compress the satellite antenna 54, the satellite antenna 54 could instead be compressed by the use of mechanical driving inside of the plastic film 60. As shown in FIG. 8, inside of the plastic film 60 of the satellite antenna 54 are two thin, rigid, rectangular plates 66 and 68 that are connected perpendicularly to each other via hinges 67 and 69 at the top 56 and bottom 58, respectively, of the satellite antenna 54 through a rod 59 along the vertical axis of the satellite antenna 54.

A first rectangular plate 66 is rigidly fixed to the rod 59 at the top 56 and bottom 58 of the satellite antenna 54, while a second plate 68 is hinged onto the rod 59 via hinges 67 and 69. To expand the satellite antenna 54, the second plate 68 is rotated into a perpendicular position to the first plate 66, using a turning knob 57 connected to hinge 69 at the bottom 58 of the satellite antenna 54. In this embodiment, the turning knob 57 separates the cellular stub 52 from the satellite antenna 54. To compress the satellite antenna 54, the second plate 68 is rotated to become substantially parallel to the first plate 66, using the turning knob 57. It should be noted that in this embodiment, the plastic film 60 does not have a circular shape, but rather a slightly rounded square shape.

Figure 9:
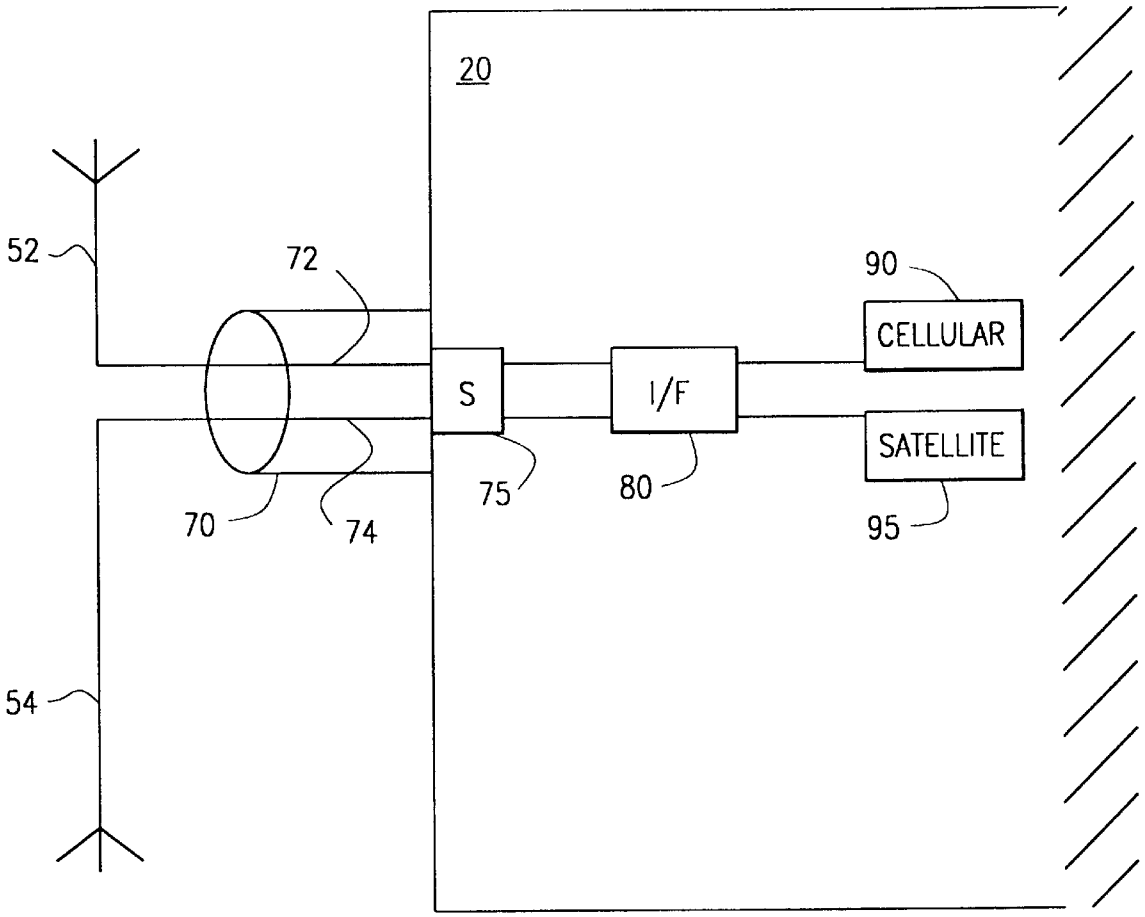
FIG. 9 is a block diagram illustrating the interface of the combined swivel antenna with circuitry located within the MS.

With reference now to FIG. 9, in order to couple the cellular and satellite ends 52 and 54, respectively, of the combined swivel antenna 50 to the applicable circuitry contained within the main housing 20, a swivel mechanism or device 70 that rotatably connects the combined swivel antenna 50 to the main housing 20 at the intersection between the cellular end 52 and the satellite end 54 is preferably hollow so that a pair of leads 72 and 74 may extend therethrough. The cellular end 52 and the satellite end 54 of the combined swivel antenna 50 are connected to cellular operating circuitry 90 and satellite operating circuitry 95, respectively, through leads 72 and 74, respectively, and interfacing circuitry 80. At least one switch 75 controls the operation of the dual-mode MS 10 in satellite mode or in cellular mode.

As discussed hereinbefore, any rotation of the combined swivel antenna 50 from a position parallel to the main housing 20 with the cellular end 52 vertically upwards activates switch 75 to change the dual-mode MS 10 to satellite mode. While in satellite mode, signals are transmitted and received only over lead 74 through switch 75, interface circuitry 80 and satellite operating circuitry 95. When the combined swivel antenna 50 is rotated back into the parallel position with the cellular end 52 vertically upwards, switch 70 is activated to switch the dual-mode MS 10 back into cellular mode. In cellular mode, signals are transmitted and received only over lead 72 through switch 75, interface circuitry 80 and cellular operating circuitry 90.

As will be recognized by those skilled in the art, the innovative concepts described in the present application can be modified and varied over a wide range of applications. Accordingly, the scope of patented subject matter should not be limited to any of the specific exemplary teachings discussed, but is instead defined by the following claims.

What is claimed is:

1. A dual-mode mobile station for operating in a cellular mode and a satellite mode, comprising:

a main housing;

a combined swivel antenna having a cellular end for operating in said cellular mode and a compressible satellite end for operating in said satellite mode, said combined swivel antenna being rotatably connected to said main housing; and a sliding lid removably attached to said main housing, said compressible satellite end being compressed between said sliding lid and said main housing to occupy a volume less than an uncompressed volume of said compressible satellite end when said dual-mode mobile station is operating in said cellular mode.

2. The dual-mode mobile station of claim 1, wherein said main housing includes a front surface having at least a keypad, a display and a speaker.

3. The dual-mode mobile station of claim 2, wherein said sliding lid is removably attached to said front surface of said main housing.

4. The dual-mode mobile station of claim 1, wherein said sliding lid has a front surface, a side surface and a back surface, said front surface and said side surface being pivotally attached via a first hinge and said side surface and said back surface being pivotally attached via a second hinge.

5. The dual-mode mobile station of claim 4, wherein said main housing includes a front surface and a back surface, said back surface of said sliding lid being pivotally attached to said back surface of said main housing via a third hinge, said front surface of said sliding lid being removably attached to said front surface of said main housing via a fastening device.

6. The dual-mode mobile station of claim 5, wherein said front, side and back surfaces of said sliding lid form a cavity when said front surface of said sliding lid is attached to said front surface of said main housing, said cellular end protruding through said cavity when said dual-mode mobile station is in cellular mode.

7. The dual-mode mobile station of claim 5, wherein said fastening device is a release latch.

8. The dual-mode mobile station of claim 5, wherein disengagement of said fastening device detaches said front surface of said sliding lid from said front surface of said main housing, exposes said compressible satellite end and expands said compressible satellite end to said uncompressed volume.

9. The dual-mode mobile station of claim 8, wherein said compressible satellite end includes foam rubber capable of compression and expansion.

10. The dual-mode mobile station of claim 8, wherein said compressible satellite end has a top end, a bottom end opposite to said top end along a vertical axis of said satellite end, a rod extending through said vertical axis of said compressible satellite end, a first rectangular plate rigidly fixed to said rod at said top and bottom ends and second rectangular plate connected to said first plate via fourth and fifth hinges at said top and bottom ends, respectively, through said rod.

11. The dual-mode mobile station of claim 10, wherein said combined swivel antenna includes a turning knob at an intersection between said cellular end and said compressible satellite end, said turning knob being connected to said fifth hinge and being configured to rotate said first plate between a compressed position of said compressible satellite end and an expanded position of said compressible satellite end, said compressed position being defined by said first and second plates being substantially parallel, said expanded position being defined by said first and second plates being perpendicular to each other.

12. The dual-mode mobile station of claim 8, wherein rotation of said combined swivel antenna from a position parallel to said main housing with said cellular end vertically upwards switches said dual-mode mobile station to said satellite mode.

13. The dual-mode mobile station of claim 12, further comprising:

a swivel device for rotatably connecting said combined swivel antenna to said main housing at an intersection between said cellular end and said compressible satellite end.

14. The dual-mode mobile station of claim 13, wherein said swivel device is hollow for receiving a first lead from said cellular end and a second lead from said compressible satellite end.

15. The dual-mode mobile station of claim 14, further comprising:

at least one switch connected to said first and second leads for switching said dual-mode mobile station between said cellular mode and said satellite mode.

16. The dual-mode mobile station of claim 8, wherein said sliding lid has an interior side and an exterior side, said sliding lid being connected to flatten out, using said first and second hinges, and rotate until said exterior side of said sliding lid lies over said back surface of said main housing, using said third hinge.

17. The dual-mode mobile station of claim 16, wherein said interior side of said front surface of said sliding lid attaches to a side surface of said main housing via an additional fastening device.

18. The dual-mode mobile station of claim 17, wherein said additional fastening device is a snap.

19. The dual-mode mobile station of claim 1, wherein said satellite end is a quadrifilar helix.

20. A method for operating a dual-mode mobile station in a cellular mode and a satellite mode, said dual-mode mobile station having a combined swivel antenna rotatably attached to a main housing of said dual-mode mobile station, said combined swivel antenna having a cellular end for operating in said cellular mode and a compressible satellite end for operating in said satellite mode, said method comprising the steps of:

rotating said cellular end of said combined antenna to a parallel position to said main housing with said cellular end extending vertically upwards to switch said dual-mode mobile station to said cellular mode;

compressing said compressible satellite end of said combined swivel antenna between a sliding lid of said dual-mode mobile station and said main housing to occupy a volume less than an uncompressed volume of said compressible satellite end, said sliding lid being removably attached to said main housing;

detaching said sliding lid from said main housing to expand said compressible satellite end to said uncompressed volume; and rotating said combined swivel antenna from said parallel position to switch said dual-mode antenna to said satellite mode.

21. The method of claim 20, wherein said step of compressing further comprises the steps of:

pivotally attaching a back surface of said sliding lid to a back surface of said main housing; and removably attaching a front surface of said sliding lid to a front surface of said main housing via a fastening device.

22. The method of claim 21, wherein said step of detaching further comprises the steps of:

disengaging said fastening device to detach said front surface of said sliding lid from said front surface of said main housing;

exposing said compressible satellite end; and expanding said compressible satellite end to said uncompressed volume.

23. The method of claim 22, wherein said step of expanding is performed by foam rubber within said compressible satellite end.

24. The method of claim 22, wherein said compressible satellite end has first and second rectangular plates therein, and wherein step of expanding further comprises the step of:

rotating said second rectangular plate within said compressible satellite end from a compressed position substantially parallel to said first rectangular plate to an expanded position perpendicular to said first rectangular plate.

25. The method of claim 24, wherein said step of compressing further comprises the step of:

rotating said second rectangular plate from said expanded position to said compressed position.

26. The method of claim 22, wherein said step of detaching further comprises the steps of:

flattening out said sliding lid; and rotating said sliding lid until an exterior side of said sliding lid li es over said back surface of said main housing.

27. The method of claim 26, wherein said step of detaching further comprises the step of:

attaching an interior side of said front surface of said sliding lid to a side surface of said main housing.

* * * * *